US009677219B2

(12) United States Patent
Woodson

(10) Patent No.: US 9,677,219 B2
(45) Date of Patent: Jun. 13, 2017

(54) CLOTHES LINE ASSEMBLY FOR WASHING AND DRYING DELICATE ITEMS

(71) Applicant: Terri Lynn Woodson, Marina Del Rey, CA (US)

(72) Inventor: Terri Lynn Woodson, Marina Del Rey, CA (US)

( * ) Notice: Subject to any disclaimer, the term of this patent is extended or adjusted under 35 U.S.C. 154(b) by 23 days.

(21) Appl. No.: 14/994,134

(22) Filed: Jan. 12, 2016

(65) Prior Publication Data

US 2016/0122940 A1 May 5, 2016

Related U.S. Application Data

(63) Continuation-in-part of application No. 14/019,335, filed on Sep. 5, 2013, now Pat. No. 9,234,308.

(60) Provisional application No. 61/697,058, filed on Sep. 5, 2012.

(51) Int. Cl.

| | |
|---|---|
| ***D06F 58/04*** | (2006.01) |
| ***D06F 95/00*** | (2006.01) |
| ***D06F 39/00*** | (2006.01) |
| *D06F 55/02* | (2006.01) |
| *D06F 37/04* | (2006.01) |

(52) U.S. Cl.

CPC ..... *D06F 95/008* (2013.01); *D06F 39/00* (2013.01); *D06F 58/04* (2013.01); *D06F 37/04* (2013.01); *D06F 55/02* (2013.01)

(58) Field of Classification Search

CPC ..... D06F 58/04; D06F 95/008; D06F 39/00; D06F 37/04; D06F 55/02

USPC ..... 34/595

See application file for complete search history.

(56) References Cited

U.S. PATENT DOCUMENTS

| | | | | |
|---|---|---|---|---|
| 2,089,266 A * | 8/1937 | Kalvin | ..... | A47F 8/02 211/85.3 |
| 2,473,408 A | 6/1949 | Alkin | | |
| 2,755,004 A | 7/1956 | Lucile | | |
| 2,815,157 A | 12/1957 | Badgley | | |
| 3,085,723 A | 4/1963 | Vanderburg | | |

(Continued)

FOREIGN PATENT DOCUMENTS

| | | | | |
|---|---|---|---|---|
| DE | 10109744 A1 * | 9/2001 | ..... | D06F 58/04 |
| JP | 01029295 | 1/1989 | | |

(Continued)

*Primary Examiner* — Stephen M Gravini

(74) *Attorney, Agent, or Firm* — Law Office of Dorian Cartwright; Dorian Cartwright

(57) ABSTRACT

A clothes line for washing and drying delicate items. An elongated member has a distal end and a proximal end. A first connector is secured to said distal end of said elongated member and configured for connection to a first portion of the laundry appliance. A second connector is secured to said proximal end of the elongated member for connection to a second portion of the appliance, the first and second connectors configured to connect the elongated member to the laundry appliance. A holding element comprises a first end and a second end, the first end of the holding element removably mounted along the length of said elongated member. The second end of the holding element is configured to releasably hold at least one delicate garment to prevent entanglements during operation of the laundry appliance. The garment can include, without limitation, lingerie underwear (e.g., a G-string garment), a blouse, a brassier, or the like.

8 Claims, 7 Drawing Sheets

(56) References Cited

U.S. PATENT DOCUMENTS

| | | | | | |
|---|---|---|---|---|---|
| 4,109,397 | A | | 8/1978 | Daily | |
| 4,617,743 | A | | 10/1986 | Barnard | |
| 4,974,967 | A | * | 12/1990 | Tsuyoshi | D06F 95/006 383/102 |
| 5,320,429 | A | | 6/1994 | Toyosawa | |
| 5,365,675 | A | | 11/1994 | Shabram | |
| 5,519,949 | A | | 5/1996 | Gibson | |
| 5,556,013 | A | * | 9/1996 | Mayer | D06F 95/008 223/1 |
| 5,743,025 | A | | 4/1998 | Jordan | |
| 5,829,083 | A | | 11/1998 | Sutton | |
| 5,971,236 | A | * | 10/1999 | DesForges | D06F 95/008 223/1 |
| 6,026,592 | A | | 2/2000 | Herr | |
| 6,067,729 | A | | 5/2000 | Willis | |
| 6,115,936 | A | | 9/2000 | Arlie | |
| 6,134,810 | A | | 10/2000 | Stockley | |
| 6,212,792 | B1 | | 4/2001 | Bier | |
| 6,234,368 | B1 | | 5/2001 | DesForges | |
| 6,536,952 | B1 | * | 3/2003 | Hsieh | D06F 95/006 220/9.1 |
| 6,742,683 | B1 | | 6/2004 | Phan | |
| 6,973,808 | B2 | * | 12/2005 | Peska | D06F 95/008 383/103 |
| 7,056,023 | B2 | | 6/2006 | Heidel | |
| 7,350,679 | B2 | | 4/2008 | Radtke et al. | |
| 7,743,953 | B2 | | 6/2010 | Okazaki | |
| 7,913,419 | B2 | | 3/2011 | Tomasi et al. | |
| 8,087,184 | B2 | | 1/2012 | Banta et al. | |
| 2004/0182117 | A1 | | 9/2004 | Fenster | |
| 2004/0264815 | A1 | | 12/2004 | Gibeau | |
| 2006/0123606 | A1 | | 6/2006 | Juan | |
| 2012/0211453 | A1 | | 8/2012 | Stegerwald et al. | |
| 2014/0137426 | A1 | | 5/2014 | Woodson | |
| 2016/0122940 | A1 | * | 5/2016 | Woodson | D06F 39/00 34/239 |

FOREIGN PATENT DOCUMENTS

| | | | | | |
|---|---|---|---|---|---|
| JP | 2000116981 | | | 4/2000 | |
| JP | 2011036487 | | | 2/2011 | |
| KR | 20090038298 | A | * | 4/2009 | D06F 58/02 |
| NZ | CA 2482088 | A1 | * | 10/2003 | D06F 37/302 |

* cited by examiner

CLOTHES LINE ASSEMBLY FOR WASHING AND DRYING DELICATE ITEMS

CROSS-REFERENCE TO RELATED PATENT APPLICATION

This application claims priority as a continuation-in-part of U.S. patent application Ser. No. 14/019,335, filed Sep. 5, 2013, which claims the benefit of U.S. Provisional Patent Application No. 61/697,058, filed Sep. 5, 2012, each of which is hereby incorporated by reference herein in their entirety.

TECHNICAL FIELD

The disclosed subject matter relates, generally, to washing delicate items, and more particularly, a clothes line assembly for reducing wear and tear of delicate garments within laundry appliances.

BACKGROUND

Given that intimate apparel is often not subject to the same wear and tear that regular garments are, it is often very delicately constructed. Adding to the delicate construction of such apparel is the proximity it shares with the wearer as well as the desired aesthetics it is expected to exude. Even in instances where intimate apparel is not nearly as delicate in construction, it is, nevertheless, constructed keeping in mind certain enhancements or features that appeal to its wearer. For example, a brassier may be constructed such that it enhances and/or supports the wearer's breasts. Similarly, specialty thongs and underwear are often constructed to enhance the buttocks of the wearer. Such a construction typically requires special care in handling, washing, drying, etc., than afforded regular garments to maintain the integrity of the offered enhancements and other features. Indeed, washing machines and dryers try to address such concerns by offering, for example, a delicate spin cycle and variations in drying temperatures. The foregoing concern is not limited to intimate apparel, but also extends to other items, for example, prosthetic devices that, too, require delicate handling when being cleaned and/or dried.

Despite efforts to address issues relating to the cleaning and drying of items requiring special care by, for example, offering a delicate spin cycle or variations in drying temperatures, such items, nevertheless, suffer damage. For example, traditional washing of bras in a standard washing machine generally results in the bra straps of two or more bras becoming entangled, forming a "Gordian Knot" that is difficult and frustrating to unravel.

In addition to offering a delicate spin cycle and variations in drying temperatures, numerous attempts have been made to eliminate this frustration by providing holders/containers for brassieres and similar garments for use during washing and/or drying. However, such efforts have predominantly suffered from various limitations in addressing the problem, and some have even introduced further complications.

Related patents and published patent applications known in the background art include the following, which are incorporated herein in their entirety.

U.S. Pat. No. 2,473,408, issued to Alkin on Jun. 14, 1949, discloses clothes hanger providing an improved form and disposition of clips which are adapted to suspend items and permit a tension to be applied to the clipped part of the item.

U.S. Pat. No. 5,320,429, issued to Toyosawa on Jun. 14, 1994, discloses a laundry net for holding a brassiere while the brassiere is being laundered, has a dome-shaped bag having a substantially circular bottom member and a substantially conical upper member joined thereto for covering cups of the brassiere.

U.S. Pat. No. 5,556,013, issued to Mayer on Sep. 17, 1996, discloses an intimate garment protector for protecting a garment or multiple garments, namely bras, during laundering. The device comprises first and second basket members that are designed and configured to receive the cup portions of at least one bra. Preferably, the basket members have a generally dome-like or conical-like shape.

U.S. Pat. No. 5,829,083, issued to Sutton on Nov. 3, 1998, discloses a device used during washing of a brassiere to protect the brassiere and maintain the shape of the cups of the brassiere. It includes an inner spherical framework contained within a larger outer spherical framework. Each framework is formed by a pair of hemispherical sections that upon being coupled together form the individual frameworks. With the inner framework open, the brassiere is fitted over the hemispherical sections, with one section being placed inside each cup of the brassiere. The sections of the inner framework with the brassiere thereon are then closed and placed inside an open outer framework. The outer framework is then closed to enclose the inner framework, and the assembly of frameworks is placed into a washing machine.

U.S. Pat. No. 5,971,236, issued to DesForges et al. on Oct. 26, 1999, discloses a device for protecting a brassiere in a washing machine that includes a pair of hemispherically shaped shells (preferably injection molded polypropylene material) adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions.

U.S. Pat. No. 6,234,368, issued to DesForges et al. on May 22, 2001, discloses a device for protecting a brassiere and other delicate undergarments during laundering and includes a pair of domed or hemispherically shaped shells adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions.

U.S. Pat. No. 6,742,683, issued to Phan on Jun. 1, 2004, discloses a device for washing, drying, and storing brassieres and bikini tops and the like comprises an outer shell having two halves that have a plurality of holes. A foraminous inner form, which also contains a plurality of holes, has an exterior surface shaped like the contours of a padded bra cup breast side. The bra cups' breast side rests against the inner form's exterior surfaces to prevent it and the bra's underwires from losing their natural curvature. The inner form is hollow and provides space for the containment of a bra's shoulder and back straps. The inner form is secured to the outer shell's two halves by a first hinge, which allows the inner form to swing from first half to second half and vice-versa, and also allows first half and second half to open and close like a clamshell. A second hinge is located between the first hinge and the inner form to allow the inner form to swing away from the outer shell's two halves and back to its original position for easy placement and removal of bra(s) inside in the device. A latching mechanism secures the device in a closed and locked or latched position and is located between the exterior and interior surfaces of the outer shell's two halves. The protruding rim on one half of the outer shell nestles within the receiving rim on the other half to prevent lateral movement of the two halves.

U.S. Pat. No. 6,973,808, issued to Peska on Dec. 13, 2005, discloses an apparatus for washing at least one item, comprising a frame having a dome shape when viewed from its end, and a generally semicircular shape when viewed from its side; and a flow through mesh on the frame which allows washing fluid (generally water) to freely flow to and from the item being washed; the apparatus having an opening through which the at least one item to be washed can be placed into and removed from the apparatus. The frame may have an endless pocket; and a stiffener disposed within the pocket, the stiffener having a length exceeding that of the endless pocket, so that ends of the stiffener overlap each other within the pocket.

U.S. Pat. No. 7,350,679, issued to Radtke et al. on Apr. 1, 2008, discloses a container for supporting a brassiere or a similar garment for cleaning and storage includes opposed flat plate members connected by a hinge, and opposed container cup members connected to the respective plate members at hinge connections for folding the container cup members over the plate members and for folding the plate members with respect to each other to form a closed container for supporting a brassiere. The plate members include hinged support members, each having an arcuate cross shape, for supporting brassiere cups between the plate members and the container cup members. Spaced apart clips secure the brassiere straps to the plate members. Spaced apart latches releasably secure the cup members to the plate members and the plate members to each other for placing the container in a compact folded position.

U.S. Pat. No. 7,743,953, issued to Okazaki et al. on Jun. 29, 2010, discloses a brassiere holder that includes two cup receiving portions, a connecting portion and a hook portion. When the cup receiving portions are pressed from the side, the connecting portion is elastically deformed to allow the two cup receiving portions to be folded back on each other such that a part of a flange portion of the two cup receiving portions is brought into contact with the other part of the flange portion and a gap gradually increasing toward the upper side is formed between the two cup receiving portions.

Traditional approaches to cleaning and drying delicate items rely on confining such items in a structure moulded to conform to the shape of the item. Other approaches have included confining such items to a bag. In addition to structural and implementation limitations these approaches present with respect to, for example, front and top loaded washers and dryers, and washers with a centrally located agitator, some approaches also tend to limit the surface area of the item being exposed to the cleaning agent, soap, detergent, water, etc. Indeed, some approaches even seem to work against the washer and dryer by hindering and limiting the cleaning and drying potential offered by such appliances. Yet other approaches tend to only accomplish separating the delicate items from the remainder, but leave unaddressed how such delicate items interact with each other within the confines of a bag.

There is therefore a need in the art for approaches that minimize the wear and tear of delicate items without any significant reduction in the cleansing or drying of said items. Accordingly, it is desirable to provide methods, systems, and media that overcome these and other deficiencies of the prior art.

BRIEF SUMMARY

To address the above-mentioned shortcomings, a clothes line assembly and corresponding method for washing and/or drying delicate items is provided.

In one embodiment, an elongated member has a distal end and a proximal end. A first connector is secured to said distal end of said elongated member and configured for connection to a first portion of the laundry appliance. A second connector is secured to said proximal end of the elongated member for connection to a second portion of the appliance, the first and second connectors configured to connect the elongated member to the laundry appliance.

In another embodiment, a holding element comprises a first end and a second end, the first end of the holding element removably mounted along the length of said elongated member. The second end of the holding element is configured to releasably hold at least one delicate garment to prevent entanglements during operation of the laundry appliance. The garment can include, without limitation, lingerie underwear (e.g., a G-string garment), a blouse, a brassier, or the like.

In yet another embodiment, the second end comprises a plurality of holes to prevent blocking of the laundry appliance operation. For example, during a wash cycle, water and soap can move through the holes to directly contact the supported garment. During a dry cycle, heated air can move through the holes.

Advantageously, delicate items can be washed without entanglement and without obstructing operation of a laundry appliance.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

It will be understood by one of ordinary skill in the art that the embodiments described herein may be adapted and modified as is appropriate for the application being addressed and that the embodiments described in more detail below may be employed in other suitable applications, and that such other additions and modifications will not depart from the scope hereof.

Figure 1:
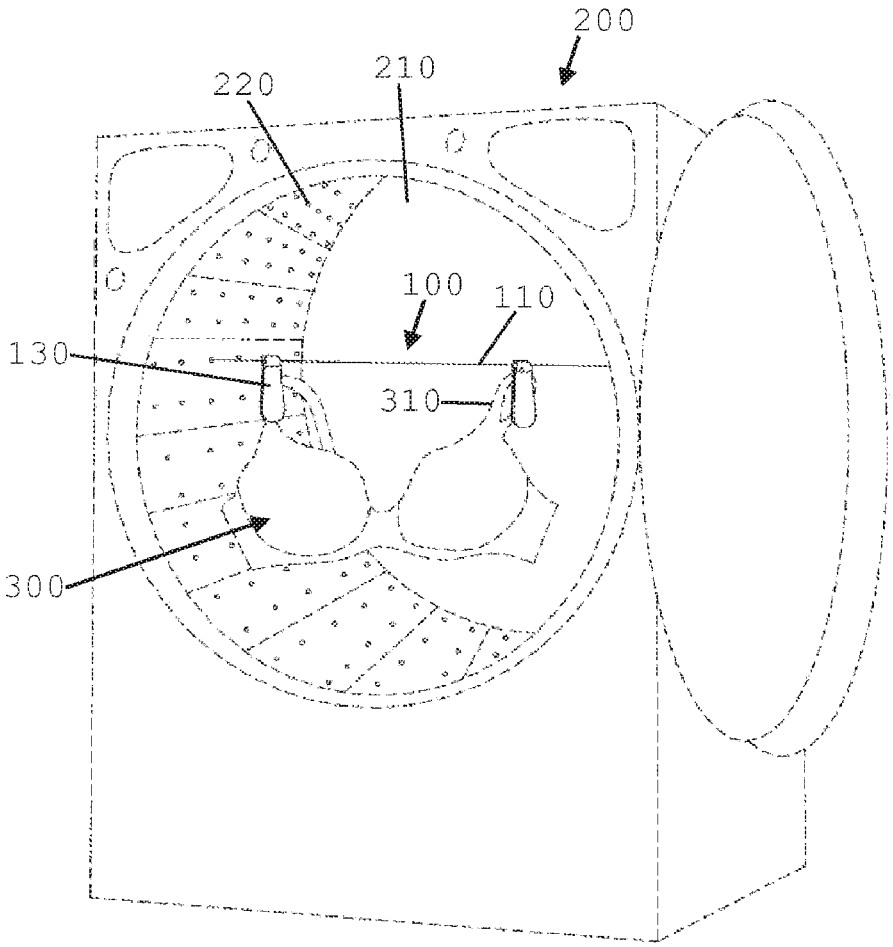
FIG. 1 is an illustration of an assembly for reducing wear and tear of products within an appliance, showing an exemplary use of the assembly according to certain embodiments of the disclosed subject matter.

FIG. 1 is an illustration of an assembly for reducing wear and tear of products within an appliance, showing an exemplary use of the assembly according to certain embodiments of the disclosed subject matter. FIG. 1 shows an appliance 200, which is a front-loading clothes washer and dryer. Appliance 200 performs a wash cycle for washing clothes and a dry cycle for drying clothes. Appliance 200 includes a tub 210, which holds the clothes for washing and drying. Tub 210 includes a plurality of holes 220 along its surface for allowing circulation and drainage of water when appliance 200 is performing the wash cycle. Holes 220 further allow drainage of water and circulation of air and water vapour during the period when appliance 200 is performing the dry cycle. While various embodiments of the disclosed subject matter have been illustrated with the example of a clothes washer and dryer, it would be apparent to one skilled in the art that the principles and teachings of the disclosed subject matter may be applied to various other appliances, such as but not limited to front-loading or top-loading washing machines, clothes dryers, dishwashers, etc.

FIG. 1 further shows assembly 100 for reducing wear and tear of a product 300 within appliance 200. In various embodiments, product 300 may be a delicate item susceptible to wear and tear within appliance 200. Product 300 shown in FIG. 1 is a brassiere, which includes delicate parts such as cups, underwires, padding, etc., and is therefore particularly prone to damage and/or deformation during washing and drying. The brassiere also includes straps 310, which are prone to entanglement during washing and drying in appliance 200, thereby forming knots that are typically untangled manually after the washing and drying cycle. Such manual disentanglement is often tedious and time consuming. Further, the entanglement and subsequent disentanglement may also cause damage to the delicate parts of the brassiere and reduce its lifespan. While various embodiments of the disclosed subject matter have been illustrated in the context of a brassiere, it would be apparent to one skilled in the art that the principles and teachings of the disclosed subject matter may be applied to various other products or delicate items, such as but not limited to other lingerie items, prosthetic devices, and etc.

Assembly 100 includes an elongated member 110, first and second connectors 120 (not shown), and at least one holding element 130. First and second connectors 120 are attached to a proximal and distal end of elongated member 110 respectively. Connectors 120 connect elongated member 110 to parts of appliance 200. In various embodiments, connectors 120 are inserted into first and second holes 220 of tub 210 to connect elongated member 110 to appliance 200. While various embodiments have been described with the example of connectors 120 that affix to holes 220 of tub 210, it will be apparent to one skilled in the art that other mechanisms for connecting elongated member 110 to appliance 200, such as vacuum cups/grippers, adhesives, hooks, screws, etc. may be used without deviating from the spirit and scope of the disclosed subject matter. Holding elements 130 are removably mounted on elongated member 110 and releasably hold product 300. Assembly 100 holds product 300 within appliance 200 in a manner that significantly mitigates the damage caused to product 300 during the operation of appliance 200. In various embodiments, assembly 100 serves to distance product 300 from moving parts of appliance 200, or areas within appliance 200 experiencing extreme temperatures that may damage product 300, or from other objects within appliance 200 that may damage product 300 during operation.

Figure 2:
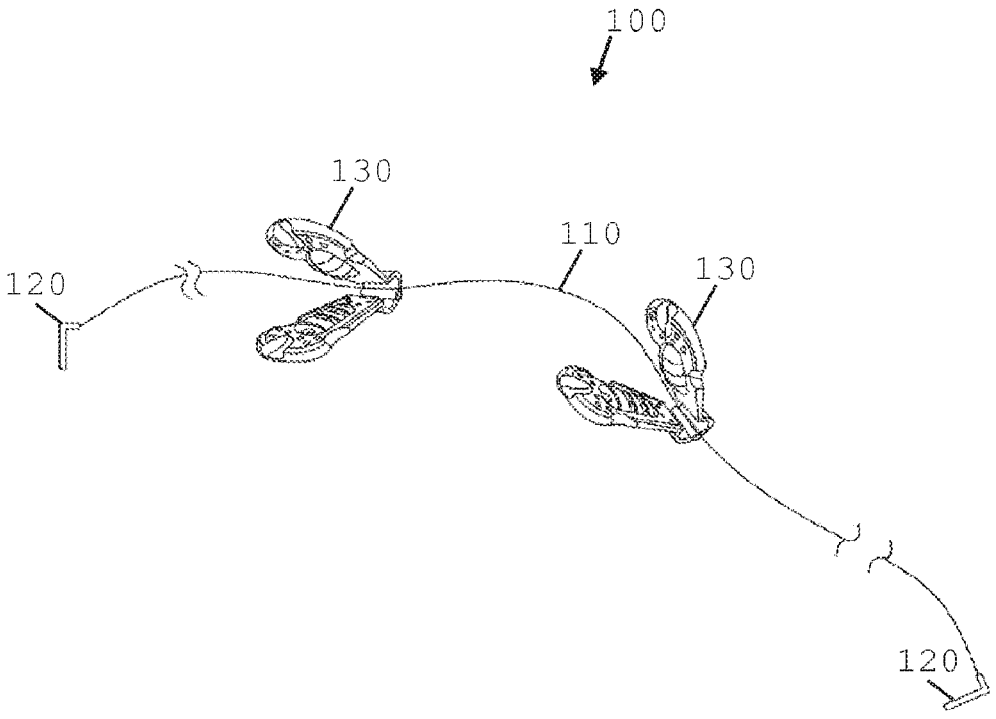
FIG. 2 is an illustration of an assembly for reducing wear and tear of products within an appliance, showing the elements of assembly 100, according to certain embodiments of the disclosed subject matter.

FIG. 2 is an illustration of an assembly for reducing wear and tear of products within an appliance, showing the elements of assembly 100, according to certain embodiments of the disclosed subject matter. FIG. 2 shows elongated member 110, connectors 120, and holding elements 130. In various embodiments, elongated member 110 is made of an extensible material, such as extensible cord or a bungee cord. In another embodiment, elongated member is an extensible telescopic rod. The extensibility of elongated member 110 allows a user to easily adapt it for use with a variety of appliances 200 with different geometries, as well as for different use configurations within appliance 200. Connectors 120 may be, without limitation, hooks, clamps, vacuum cups, adhesive pads, or other suitable fastening mechanisms. In various embodiments, connectors 120 removably connect elongated member 110 to appliance 200.

Holding elements 130 hold product 300 to reduce wear and tear suffered by it during operation of appliance 200. Holding element 130 includes a mechanism for holding product 300, and a mechanism for mounting itself on elongated member 110. In various embodiments, holding element 130 has a jaw-like structure for gripping product 300 securely. In addition, in various embodiments, holding element 130 has smooth and rounded edges to further ameliorate the wear and tear of product 300.

Figure 3:
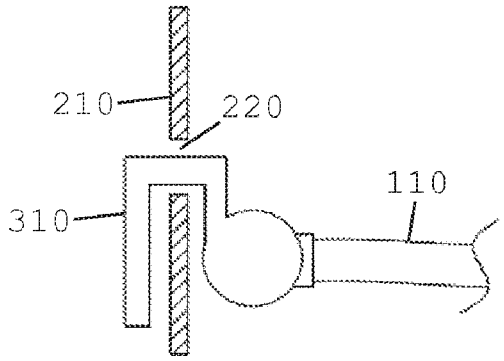
FIGS. 3-5 illustrate three connectors suitable for use with an assembly for reducing wear and tear of products within an appliance, according to certain embodiments of the disclosed subject matter.
Figure 4:
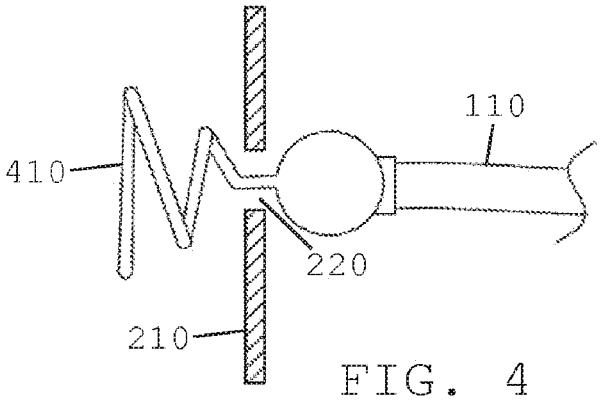
Figure 5:
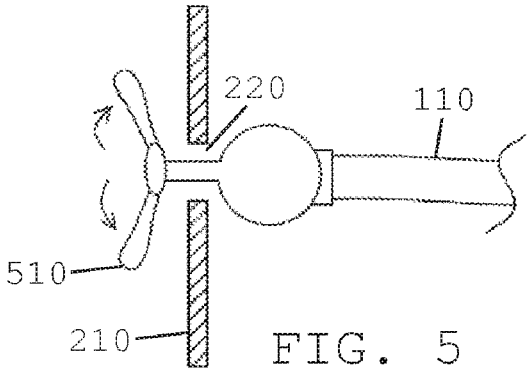

FIGS. 3-5 illustrate three connectors suitable for use with an assembly for reducing wear and tear of products within an appliance, according to certain embodiments of the disclosed subject matter. FIG. 3 shows a hook connector 310, an embodiment of connector 120. Hook connector 310 is attached to an end of elongated member 110 and inserted through hole 220 to connect elongated member 110 to tub 210 as shown. FIG. 4 shows a screw connector 410, another embodiment of connector 120. Screw connector 410 is attached to an end of elongated member 110 and inserted and screwed into hole 220 to connect elongated member 110 to tub 210 as shown. Screw connector 410 has a substantially helical shape, with increasing radius as shown. Such a shape allows ease of insertion into hole 220, while still providing a snug and secure fit between screw connector 410 and tub 210. FIG. 5 shows a snap-on connector 510, another embodiment of connector 120. Snap-on connector 510 is attached to an end of elongated member 110 and inserted and snapped into position in hole 220 to connect elongated member 110 to tub 210 as shown.

Figure 6:
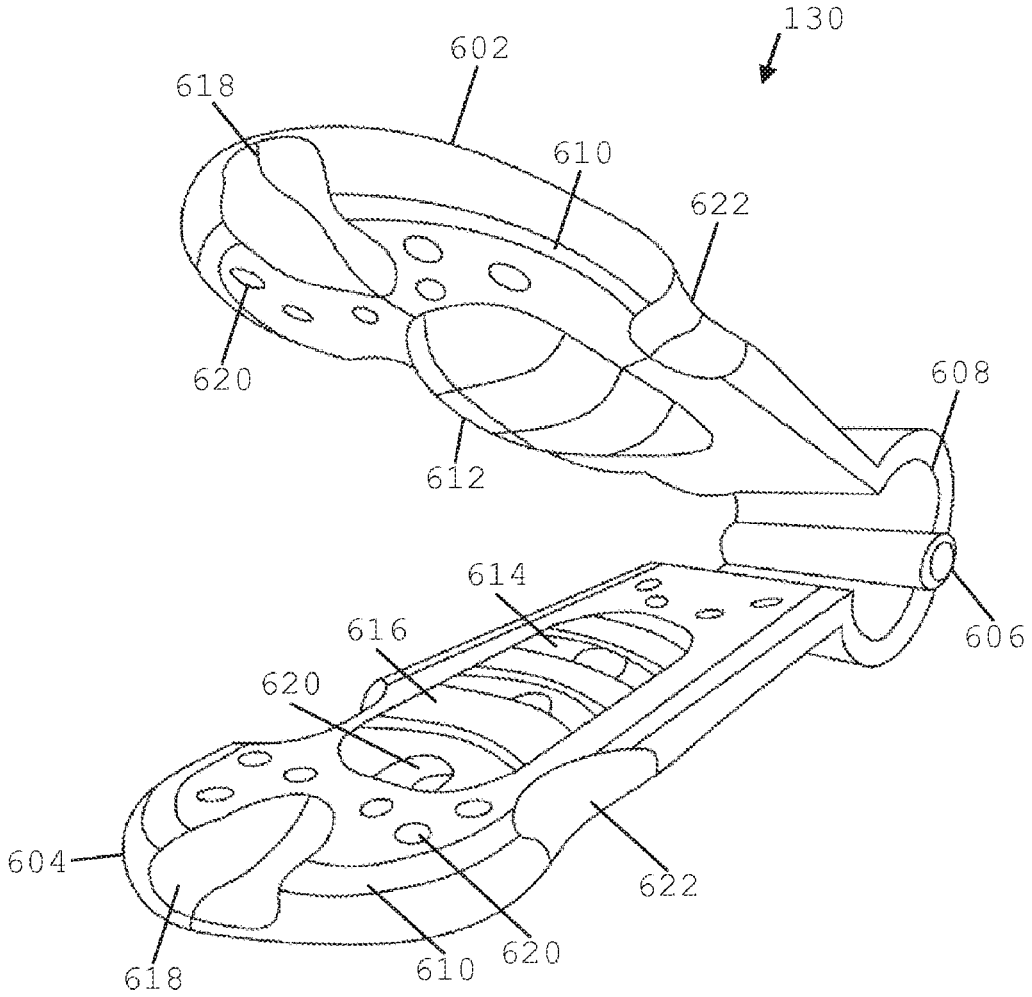
FIG. 6 is an illustration of a holding element suitable for use with an assembly for reducing wear and tear of products within an appliance, according to certain embodiments of the disclosed subject matter.

FIG. 6 is an illustration of a holding element suitable for use with an assembly for reducing wear and tear of products within an appliance, according to certain embodiments of the disclosed subject matter. FIG. 6 shows a structure of holding element 130 that will secure a product 300 while allowing adequate water and air flow to product 300 to facilitate washing and drying. Holding element 130 shown in the figure has a jaw-like structure, and includes an upper lip 602 and a lower lip 604. Upper lip 602 and lower lip 604 are connected by hinge 606. Lips 602 and 604 are shaped to form an elongated member channel 608, which houses elongated member 110 during use of holding element 130. Further, lips 602 and 604 have interlocks 610 that lock into each other when lips 602 and 604 are pressed shut, and keep them shut during use. Upper lip 602 has a convex surface 612, and lower lip 604 has a concave surface 614. Surfaces 612 and 614 are shaped to fit substantially snugly with each other when lips 602 and 604 are pressed shut. In various embodiments, at least one of surfaces 612 and 614 is made of compressible material, such as rubber. Lower lip 604 further includes one or more transverse bands 616, which may be used to weave with a part of product 300 to secure product 300 with holding element 130. In certain embodiments, transverse bands 616 may be strong rubber bands. Lips 602 and 604 further have recesses 618 that provide space for housing the portion of product 300 that connects the parts retained within holding element 130 and the remainder of product 300. In certain embodiments, recesses 618 have a smooth and rounded surface, and are composed of soft material, to minimize wear and tear to product 300.

For washing and drying of product 300, for example a brassiere, a part of product 300, for example the straps 310 of the brassiere, may be weaved into transverse bands 616 before snapping upper lip 602 and lower lip 604 shut to firmly hold the brassiere. The shape of surfaces 612 and 614, in conjunction with the compressible material used therein, provides a firm grip over straps 310 to withstand the strains of washing and drying, while minimizing the risk of wear and tear. Recesses 618 house the remaining portion of straps 310 and/or the connection between the brassiere and straps 310. As a result, only a small part of product 300 is covered by holding element 130, and a majority of the surface area of product 300 is directly accessible to the washing liquid/water and air for effective washing and drying.

Holding element 130 further includes circulation holes 620, which allow washing fluids and air to circulate within holding element 130, thereby providing for washing and drying of portions of product 300 retained within holding element 130 as well. In various embodiments, finger tabs 622 are provided in at least one of lips 602 and 604 to facilitate easy opening of holding element 130.

In certain embodiments, hinge 606 includes a locking mechanism. The locking mechanism, when in an unlocked position, allows lips 602 and 604 to rotate along hinge 606 relative to each other. Once the locking mechanism is turned to a locked position, upper lip 602 and lower lip 604 are securely abutted against each other, and hold product 300 as well as elongated member 110 firmly.

Figure 7:
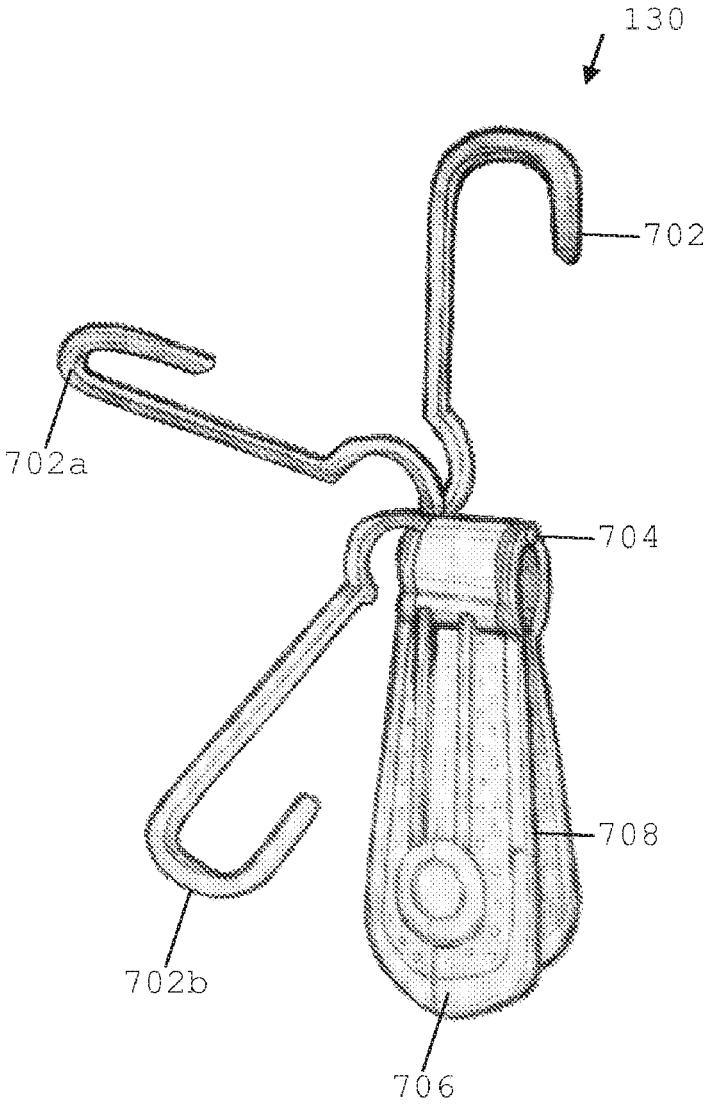
FIG. 7 is an illustration of another holding element suitable for use with an assembly for reducing wear and tear of products within an appliance, according to certain embodiments of the disclosed subject matter.

FIG. 7 is an illustration of another holding element suitable for use with an assembly for reducing wear and tear of products within an appliance, according to certain embodiments of the disclosed subject matter. The figure shows a holding element 130 that includes a hanging hook 702. Hanging hook 702 is pivotally connected with a hinge 704, and can rotate along the axis of the hinge, as shown by rotating positions 702*a* and 702*b* of hanging hook 702. Hanging hook 702 may be used to hang product 300 in order to, for example, air dry or store product 300. During use within appliance 200, hanging hook may be rotated to recede into a hook cavity 706 in a lip 708, to prevent damage during operation of appliance 200.

Figure 8:
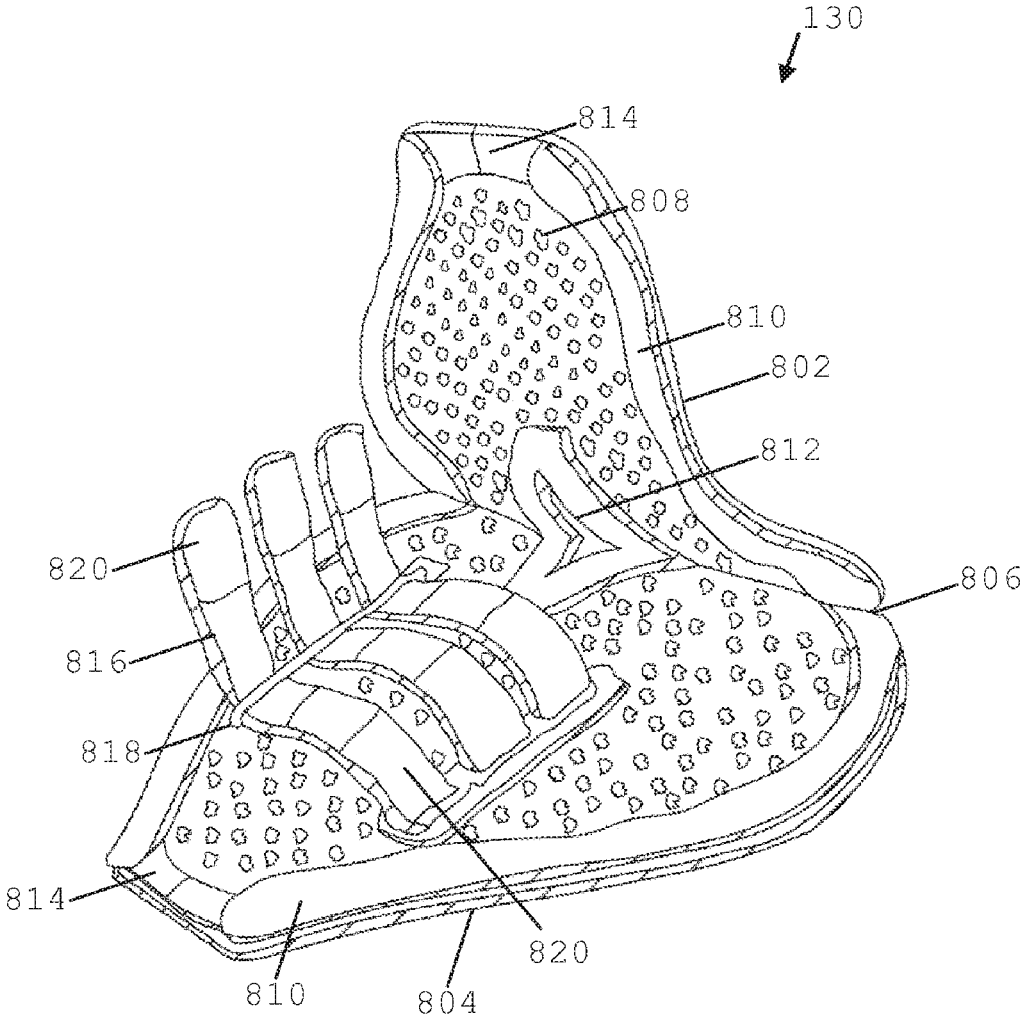
FIG. 8 is an illustration of yet another holding element suitable for use with an assembly for reducing wear and tear of products within an appliance, according to certain embodiments of the disclosed subject matter.

FIG. 8 is an illustration of yet another holding element suitable for use with an assembly for reducing wear and tear of products within an appliance, according to certain embodiments of the disclosed subject matter. Holding element 130 shown in the figure includes an upper lip 802 and a lower lip 804 joined together at joint 806. Lips 802 and 804 have circulation holes 808, which allow washing fluids and air to circulate within holding element 130, thereby providing for washing and drying of portions of product 300 retained within holding element 130 as well. In various embodiments, lips 802 and 804 are made of soft, strong, and flexible material such as polymers. Lips 802 and 804 may be closed shut by the use of closing elements 810 provided substantially along the peripheries of lips 802 and 804. In various embodiments, closing elements 810 are, without limitation, patches of Velcro® hooks and loops, interlocking Ziploc® type members, or other mechanisms for reversible and reusable fastening.

Holding element 130 also includes a perforation 812 to facilitate better circulation of washing fluids and air within the holding element 130. In certain embodiments, perforation 812 may also be used to removably attach holding element 130 with elongated member 110. Further, in certain embodiments, elongated member 110 may be encircled by upper lip 802 and lower lip 804 once they have been closed using closing elements 810.

Recesses 814 are provided along the periphery of holding element 130 to provide space to accommodate the connecting portion of product 300. Holding element 130 further includes one or more binders 816 attached to lower lip 804. Binders 816 are wound around a loop 818 as shown, and include fastening elements 820 for securing binders 816.

In an exemplary use case in accordance with certain embodiments, binders 816 are tightened over brassiere straps 310 woven through them, and secured using fastening elements 820. The remaining portion of straps 310 exits holding element 130 through recesses 814. Elongated member 110 is attached to holding element 130 by encircling it within lips 802 and 804. Alternatively, a portion of elongated member 110 may be received in holding element 130 through perforation 812 to achieve the desired attachment. The brassiere is thus suspended from elongated member 110 using holding element 130 inside tub 210 for the washing and drying cycle for the brassiere. Circulation holes 808 and perforation 812 provide for circulation of washing fluids and air within holding element 130 to enable cleaning and drying of straps 310 retained inside holding element 130.

Figure 9:
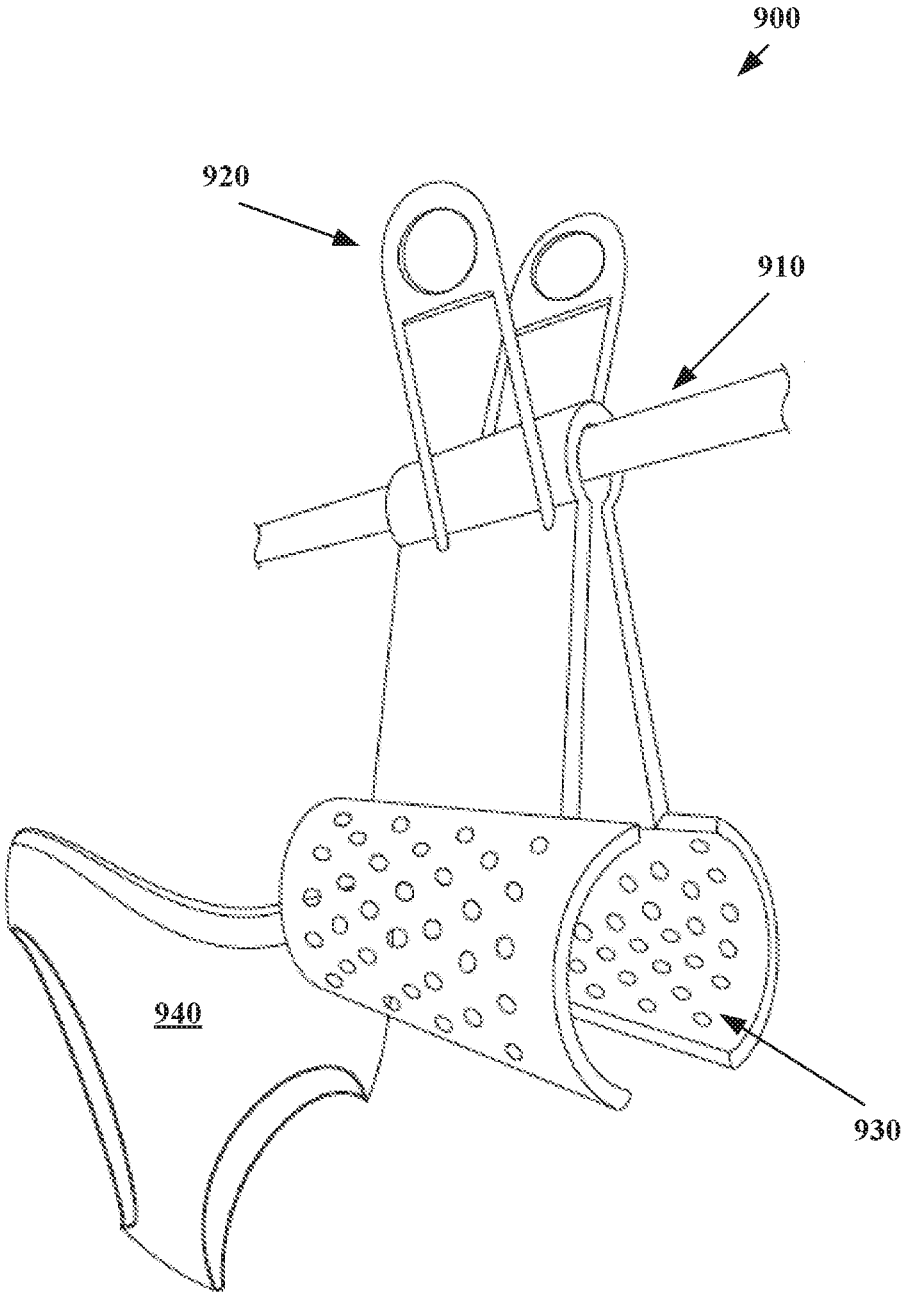
FIG. 9 is an illustration of still another holding element suitable for use with an assembly for reducing wear and tear of products within an appliance, according to certain embodiments of the disclosed subject matter.

FIG. 9 is an illustration of still another holding element suitable for use with an assembly for reducing wear and tear of products within an appliance, according to certain embodiments of the disclosed subject matter. Holding element 900 is particularly useful for larger garments such as underwear 940 that may not be adequately supported by holding clips with a smaller footprint, as opposed to using multiple smaller holding clips. Smaller garments (e.g., brassieres) can also be supported by the larger footprint. Further, the holding element 900 can be suitable for just a washing machine, just a dryer, or for both. Specific modifications can be made for certain manufacturers within the spirit of the current invention.

The holding element 900 can be placed at any location along a secure line 910. Several holding elements 900 can be simultaneously held by the secure line 910 for washing several garments during the same cycle. Handles 920 are squeezed together, in some cases, to open a lower portion of the clip 930 and slide in the garment. Optionally, the handles 920 are rotated in the opposite direction for a low profile during operation of an appliance.

In yet another embodiment, the second end comprises a plurality of holes to prevent blocking of the laundry appliance operation. For example, during a wash cycle, water and soap can move through the holes to directly contact the supported garment. During a dry cycle, heated air can move through the porous holes.

The holding clip 910, and other holding clips described herein, can be designed for just a wash cycle, just a dry cycle, or for both. For example, the holes can be larger for a wash cycle embodiment than a dryer embodiment to accommodate for suds and the viscosity of water versus air. Additionally, materials used for washing can be waterproof while materials for drying can be heat resistance to prevent too much direct contact heat to garments.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

The invention claimed is:

1. An assembly for reducing wear and tear of delicate garments within a laundry appliance, the assembly comprising:

an elongated member having a distal end and a proximal end;

a first connector secured to said distal end of said elongated member and configured for connection to a first portion of the laundry appliance, a second connector secured to said proximal end of the elongated member for connection to a second portion of the appliance, the first and second connectors configured to connect the elongated member to the laundry appliance; and a holding element comprising a first end and a second end, the first end of the holding element removably mounted along a length of said elongated member, and the second end of the holding element configured to releasably hold at least one delicate garment to prevent entanglements during operation of the laundry appliance, wherein the second end comprises a plurality of holes to prevent blocking of the laundry appliance operation.

2. The assembly of claim 1, wherein the elongated member is made out of a material with elastic properties.

3. The assembly of claim 1, wherein the first and second connectors removably connect to parts horizontally displaced receiving parts of said laundry appliance.

4. The assembly of claim 1, wherein the delicate garment comprises intimate apparel.

5. The assembly of claim 1, wherein the delicate garment comprises underwear.

6. The assembly of claim 1, wherein the laundry appliance is a washing machine.

7. The assembly of claim 1, wherein the laundry appliance is a clothing dryer.

8. The assembly of claim 1, wherein the holding element has smooth rounded edges.

* * * * *